US012324955B2

(12) United States Patent
Ito et al.

(10) Patent No.: US 12,324,955 B2
(45) Date of Patent: Jun. 10, 2025

(54) SEESAW EXERCISE DEVICE

(71) Applicant: Kabushiki Kaisha SANKEI, Osaka (JP)

(72) Inventors: Maika Ito, Osaka (JP); Michiyo Ito, Osaka (JP)

(73) Assignee: KABUSHIKI KAISHA SANKEI, Osaka (JP)

( * ) Notice: Subject to any disclaimer, the term of this patent is extended or adjusted under 35 U.S.C. 154(b) by 215 days.

(21) Appl. No.: 18/199,287

(22) Filed: May 18, 2023

(65) Prior Publication Data

US 2023/0398403 A1 Dec. 14, 2023

(30) Foreign Application Priority Data

Jun. 10, 2022 (JP) ..... 2022-094159

(51) Int. Cl.
*A63B 22/16* (2006.01)

(52) U.S. Cl.
CPC ..... *A63B 22/16* (2013.01)

(58) Field of Classification Search
CPC .... A63B 22/16; A63B 22/0056; A63B 26/003
See application file for complete search history.

(56) References Cited

U.S. PATENT DOCUMENTS 4,817,950 A 4/1989 Goo
5,328,421 A * 7/1994 Stanalajczo ..... A63B 22/16 482/79
5,647,830 A * 7/1997 Togao ..... A63B 22/18 482/79
5,891,002 A * 4/1999 Maki ..... A63B 22/16 482/79
5,897,474 A * 4/1999 Romero ..... A63B 22/14 482/79
6,705,977 B1 * 3/2004 Ziak ..... A63B 22/18 482/79
6,916,276 B1 * 7/2005 Robinson ..... A63B 69/0093 482/80
7,775,952 B1 8/2010 Curran
11,369,839 B2 * 6/2022 Mrzlak ..... A63B 21/4034
(Continued)

FOREIGN PATENT DOCUMENTS

CN 101095644 A 1/2008
EP 1284152 A1 2/2003
(Continued)

*Primary Examiner* — Zachary T Moore
(74) *Attorney, Agent, or Firm* — Kratz, Quintos & Hanson, LLP

(57) ABSTRACT

A seesaw exercise device includes: a base plate that is rectangular; a round bar that is fixed to a lower surface of the base plate along a longitudinal center line of the base plate in a manner of extending in a left-right direction, and a pair of square bars that are fixed to the lower surface of the base plate in a manner of holding the round bar therebetween in a front-rear direction, wherein when the base plate is pushed down by a user, the base plate performs a seesaw motion in the front-rear direction with the round bar as a rotation fulcrum, and three parts including an arc surface portion of the round bar, a corner portion of each of the two square bars, and a corner portion of the long side of the base plate, which are separated from one another, are grounded.

5 Claims, 12 Drawing Sheets

(56) References Cited

U.S. PATENT DOCUMENTS

| | | | | |
|---|---|---|---|---|
| 2006/0270536 | A1* | 11/2006 | Tukada | A63B 26/003<br>482/148 |
| 2008/0242515 | A1 | 10/2008 | Odien | |
| 2012/0252645 | A1 | 2/2012 | Kouno | |
| 2019/0030393 | A1* | 1/2019 | Petersen | A63B 21/0004 |
| 2024/0108942 | A1* | 4/2024 | Weiss | A63B 26/003 |

FOREIGN PATENT DOCUMENTS

| | | | |
|---|---|---|---|
| JP | 3012203 | U | 6/1995 |
| JP | 2002-200192 | A | 7/2002 |
| JP | 2009-165813 | A | 7/2009 |
| JP | 6784469 | B1 | 11/2020 |
| JP | 6802557 | B2 | 12/2020 |
| JP | 6821082 | B1 | 1/2021 |
| KR | 10-2013-0074439 | A | 7/2013 |

* cited by examiner

SEESAW EXERCISE DEVICE

BACKGROUND

Technical Field

The present invention relates to a safe seesaw exercise device which is useful for training muscles of lower limbs, developing sense of balance, and other health promotion, and which is easy to carry and can be used conveniently on a daily basis, especially for elderly people, sickly people, etc.

Related Art

Japanese Utility Model Registration No. 3012203 discloses an inexpensive health appliance mainly for improving muscle training of legs and loins and sense of balance at home by swinging a wooden base plate with both left and right feet placed on the wooden base plate side by side.

This health appliance is considered to be a known art closest to the present invention in that it is not provided with a support base, a frame or the like for bearing the swing fulcrum of the base plate, and merely has, so to speak, the minimum necessary configuration.

SUMMARY

However, the health appliance described in Japanese Utility Model Registration No. 3012203 has the configuration such that "a fulcrum portion 2 made of metal and having a hemispherical protrusion 2*a* is installed at a central portion of a lower surface 1*b* of a flat plate portion 1", as described in paragraph [0018] and that "the flat plate portion 1 is inclined front-and-rear and left-and-right in any direction (360 degrees), and a part of the flat plate portion 1 comes into contact with the ground or the floor surface", as described in the subsequent paragraph [0019]. That is, the protrusion 2*a* of the fulcrum portion 2 is hemispherical (conical) and is in point contact with the ground or floor surface (grounding surface), so that the flat plate portion 1 always swings in all directions (360 degrees) depending on the position, angle, strength and the like at which the user applies push-down force (stepping force) to the flat plate portion 1 from above, and is always inclined in a non-constant direction.

As a result, the user cannot stand on the flat plate portion 1 in a stable manner, which makes the user feel uneasy considerably, and poses the risk of tumbling or falling, especially for elderly people and sickly people. In addition, the use of the appliance does not involve shifting of the body weight, but merely involves changing of the center of gravity, thus causing the problem such that the user may become bored early, and the load that can be applied for training is insufficient.

The present invention aims at improving such problems, and in order to achieve the purpose, according to a first aspect of the present invention, a seesaw exercise device includes: a base plate that is rectangular in a plan view; a round bar that is attached fixedly to a lower surface of the base plate along a longitudinal center line of the base plate in a manner of extending in a left-right direction by a constant length which is as long as a long side of the base plate, and a pair of parallel square bars that are attached fixedly to the lower surface of the base plate in a state of holding the round bar therebetween in a front-rear direction, wherein when the base plate is pushed down by a user, the base plate performs a seesaw motion in the front-rear direction with the round bar as a rotation fulcrum, and three parts including an arc surface portion of the round bar, a corner portion of each of the two square bars, and a corner portion of each of the long sides of the base plate, which are separated from one another, are grounded.

According to a second aspect of the present invention, a pair of front and rear finger/toe hooking ridges which are identical to or different from each other are arranged in parallel with the round bar near the long sides serving as front and rear end portions on an upper surface of the base plate.

According to a third aspect of the present invention, a protective mat for preventing hands or feet of the user from slipping is laid between the front and rear finger/toe hooking ridges arranged on the upper surface of the base plate.

According to a fourth aspect of the present invention, the round bar serving as the rotation fulcrum of the base plate which performs the seesaw motion and the two square bars serving as reinforcing members for the round bar are each attached fixedly to the lower surface of the base plate by an adhesive and/or a plurality of flat-headed screws screwed from above the base plate.

According to a fifth aspect of the present invention, the base plate, the round bar, and the two square bars are all made of a wooden material, a size of the base plate is set to 300 mm×360 mm both inclusive, a thickness of the base plate is set to 15 mm to 25 mm both inclusive, a diameter of the round bar is set to 40 mm to 50 mm both inclusive, a size of each of the two square bars is set to 25 mm×45 mm inclusive, and an inclination angle of the base plate, at which the base plate intersects a grounding surface during the seesaw motion, is set to 10 degrees to 25 degrees both inclusive.

According to the configuration of the first aspect of the present invention, the user in a standing posture or a sitting posture places both feet on the base plate which performs the seesaw motion, and repeats the motion of stepping on the front end portion which is a long side of the base plate with the tips of toes and the motion of stepping on the rear end portion of the base plate with the heel to alternately perform a seesaw motion in the front-rear direction, whereby the device can stretch the Achilles tendons, triceps surae muscles, gluteus maximus muscles and other rear muscles of the lower body to expand the range of motion of the ankles, knee joints, etc., which also helps develop the sense of balance, or the like.

Further, the user places his or her waist periphery on the base plate, makes a posture of lying on the stomach or lying on the back by turning his or her upper body toward one of the front side and rear side of the base plate and turning his or her lower body toward the other remaining side of the base plate, and performs the seesaw motion of the base plate in the front-rear direction, whereby the device can stretch the back muscles and abdominal muscles to expand the range of motion of the hip joints, shoulder joints, etc., exercise the pelvis, and correct the posture, and so forth.

In addition, since the total of three parts including the arc surface portion of the round bar which is the rotation fulcrum of the base plate performing the seesaw motion, the corner portion of each of the two square bars which hold the round bar therebetween in the front-rear direction, and the corner portion of each of the long sides of the base plate, which are separated from one another, are grounded in a state of being in line contact with the grounding surface, there is not any risk of swinging in all directions (360 degrees) unlike in the prior art described above, and a stable and firm installation state can be maintained at all times, and thus, not only able-bodied young men and women, but also elderly people, sickly people and physically handicapped people can use the device safely without any danger of slipping down.

In this case, when the configuration of the second aspect of the present invention is adopted, fingers or toes are hooked (entangled) to any one of the pair of front and rear finger/toe hooking ridges, thereby making it possible to train the gripping force of the fingers or toes or stimulate (shiatsu massage) the pressure points by placing the palm of the hand or the sole of the foot, and also making it possible to use the remaining other finger/toe hooking ridge as a stopper for preventing the slip-off of the foot.

When the configuration of the third aspect of the present invention is adopted, the user's hands and feet or body placed on the base plate can be safely protected by the protective mat without the risk of being injured, and a non-slip effect for the hands and feet can be provided.

When the configuration of the fourth aspect of the present invention is adopted, not only the round bar serving as the rotation fulcrum but also the pair of front and rear square bars serving as reinforcing members are attached fixedly to the lower surface of the base plate, so that the central portion of the base plate is the heaviest portion. When the base plate is pushed down (stepped on) by the user, therefore, its round bar arcs slowly as if the round bar is rolling. In this sense, there is neither a risk that the base plate swings in all directions (360 degrees), nor a risk that the base plate performs a quick seesaw motion, so that even when an elderly person stands on the base plate with both feet, the elderly person does not feel uneasy, and there is not any risk that the elderly person slips down the base plate and falls over.

When the configuration of the fifth aspect of the present invention is adopted, the seesaw exercise device having a simple configuration includes a rectangular base plate, a round bar that is attached fixedly along the longitudinal center line of the base plate and a pair of square bars that are attached fixedly to the base plate in a state of holding the round bar therebetween in the front-rear direction, and the constituent members of the seesaw exercise device are all made of wooden materials.

Therefore, the seesaw exercise device can be handled in the same way as indoor furniture, and can be carried to a desired location, installed, and used repeatedly on a daily basis to facilitate stretching, training, rehabilitation, and other health promotion.

DETAILED DESCRIPTION

Figure 1:
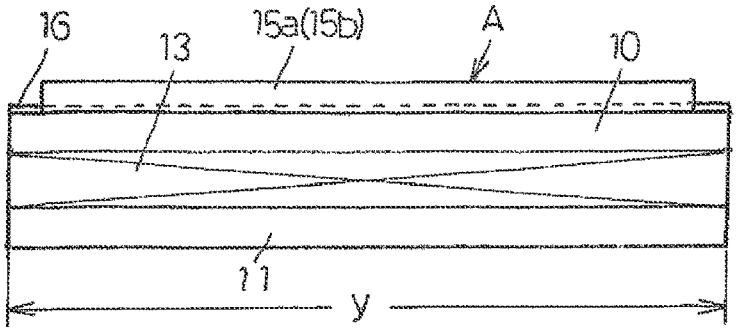
FIG. 1 is a front view of a seesaw exercise device according to a preferred embodiment of the present invention.
Figure 2:
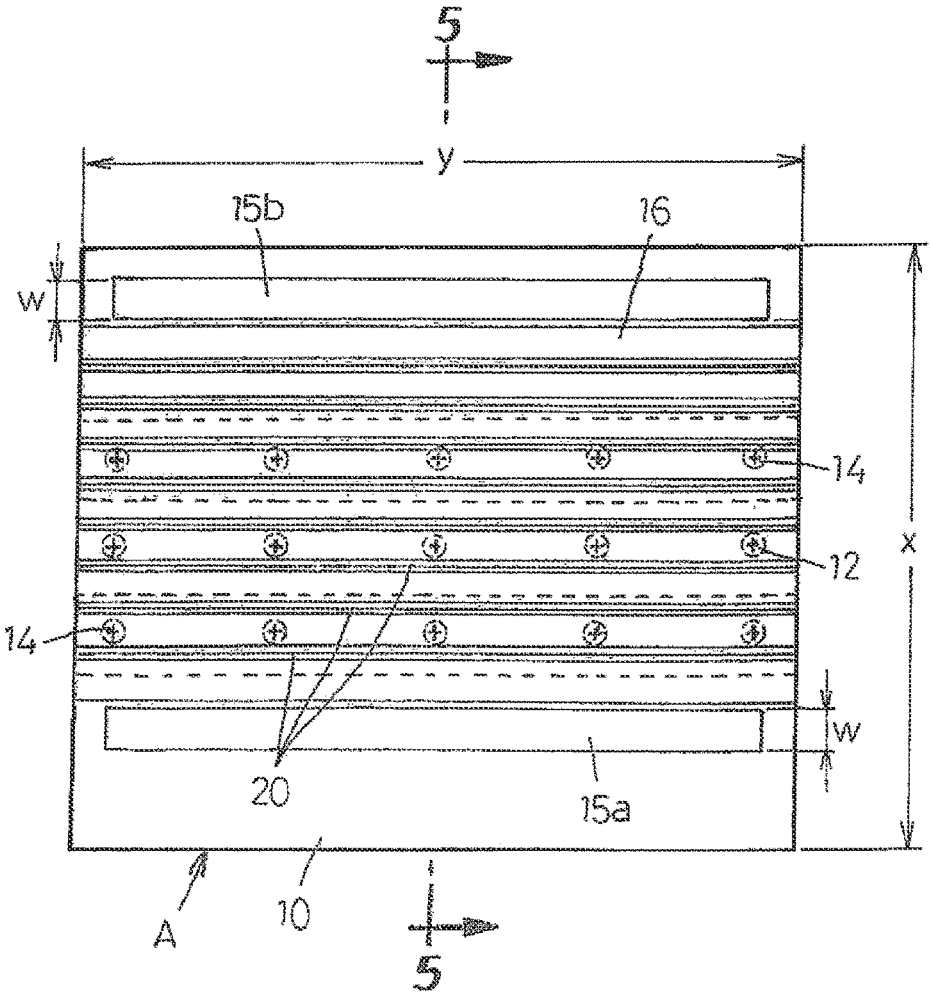
FIG. 2 is a plan view of FIG. 1.
Figure 3:
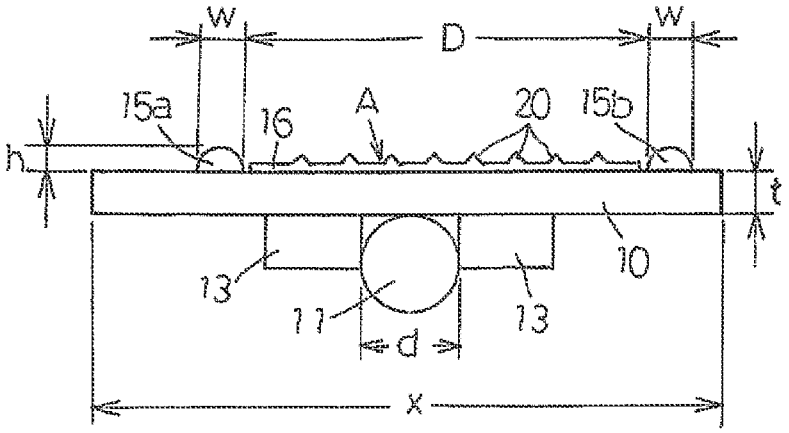
FIG. 3 is a side view of FIG. 1.
Figure 4:
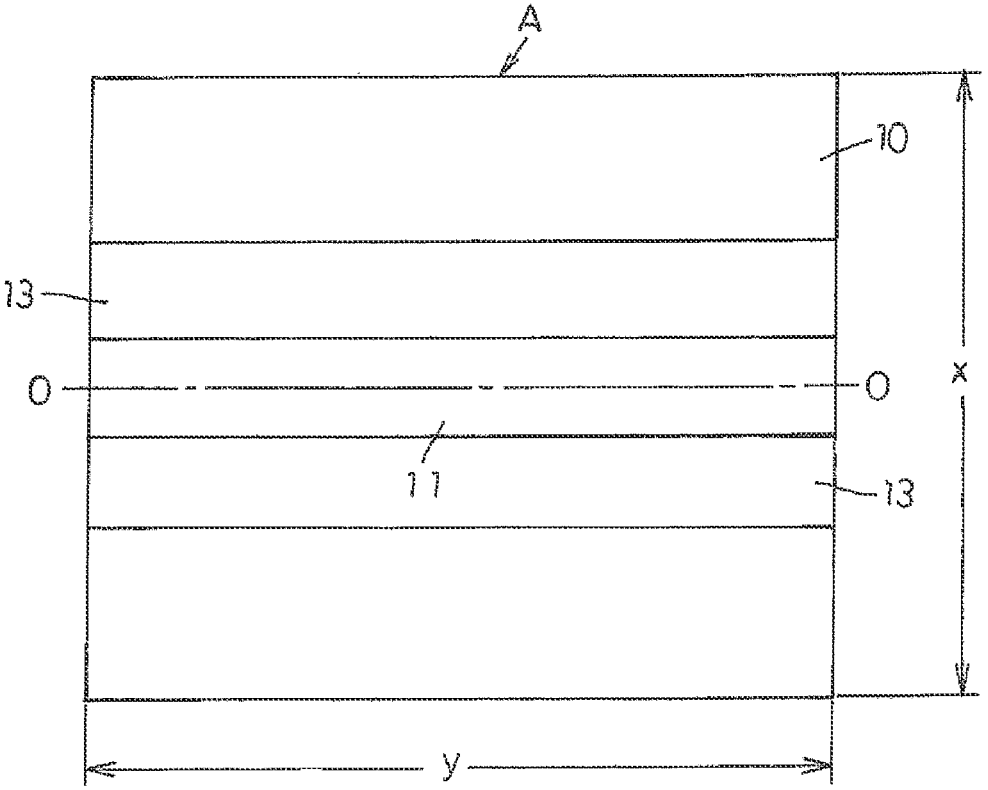
FIG. 4 is a bottom view of FIG. 1.
Figure 5:
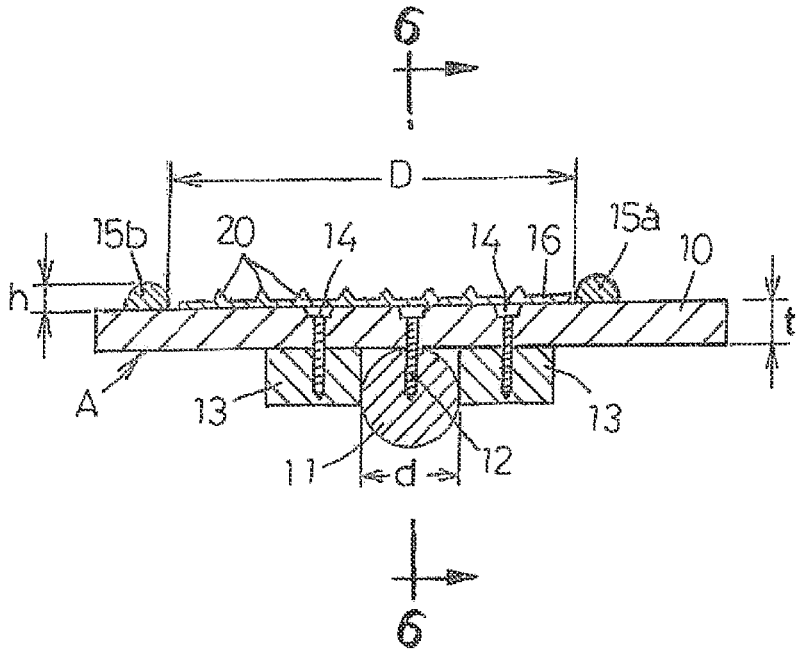
FIG. 5 is a sectional view taken along line 5-5 in FIG. 2.
Figure 6:
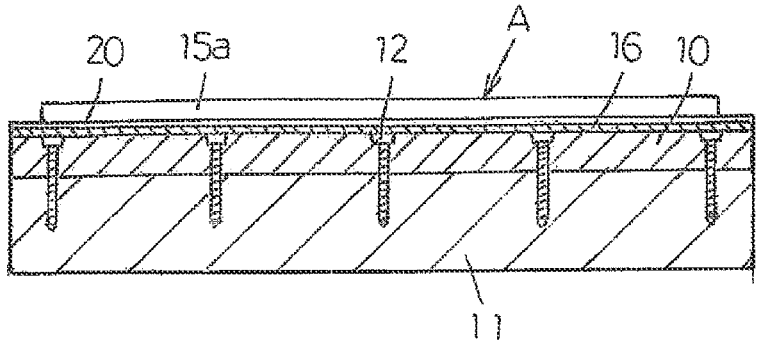
FIG. 6 is a sectional view taken along line 6-6 in FIG. 5.

Hereinafter, preferred embodiments of the present invention will be described in detail with reference to the drawings. FIGS. 1 to 6 show a seesaw exercise device A made of a wooden material, wherein a base plate 10 which performs seesaw motion has a constant plate thickness t (for example, 15 mm to 25 mm both inclusive, preferably 18 mm), and is formed of balsa wood, various furniture materials, or other wooden materials, which are lightweight but strong, into a rectangular shape in a plan view having a size (area) defined by, for example, a pair of front and rear long sides y of 360 mm to 400 mm both inclusive (preferably 360 mm) and a pair of left and right short sides x of 300 mm to 350 mm both inclusive (preferably 300 mm).

On the lower surface of the base plate 10, the round bar 11 made of the wooden material and serving as a rotation fulcrum of the seesaw motion is attached fixedly in a state of extending (crossing) in the left-right direction along the longitudinal center line O-O of the base plate 10 by the same constant length as the long sides y.

That is, the round bar 11 has a diameter d (for example, 40 mm to 50 mm both inclusive, preferably 40 mm) which is larger than the plate thickness t of the base plate 10, and a central portion located on the longitudinal center line O-O of the base plate 10 is assembled and integrated with an arc surface of the round bar 11 from above by a plurality of (five in the illustration) flat-headed screws 12 screwed from above in a so-called line-contact mounting state.

In addition, the round bar 11 is firmly and stably held by a pair of square bars 13 for reinforcement therebetween in the front-rear direction. Each of the two square bars 13 is made of a wooden material having a size of, for example, 30 mm×50 mm inclusive, preferably 25 mm×45 mm inclusive, and is also assembled and integrated with the base plate 10 by a plurality of flat-headed screws 14 (also five in the illustration) which are each screwed from above the base plate 10.

In the illustrated embodiment, each of the round bar 11 and the two square bars 13 is attached fixedly to the lower surface of the base plate 10 by the plurality of the flat-headed screws 12 or 14, but each of the round bar 11 and the two square bars 13 may also be attached fixedly by an adhesive (not shown) instead of or in addition to the flat-headed screws 12 or 14.

Figure 7:
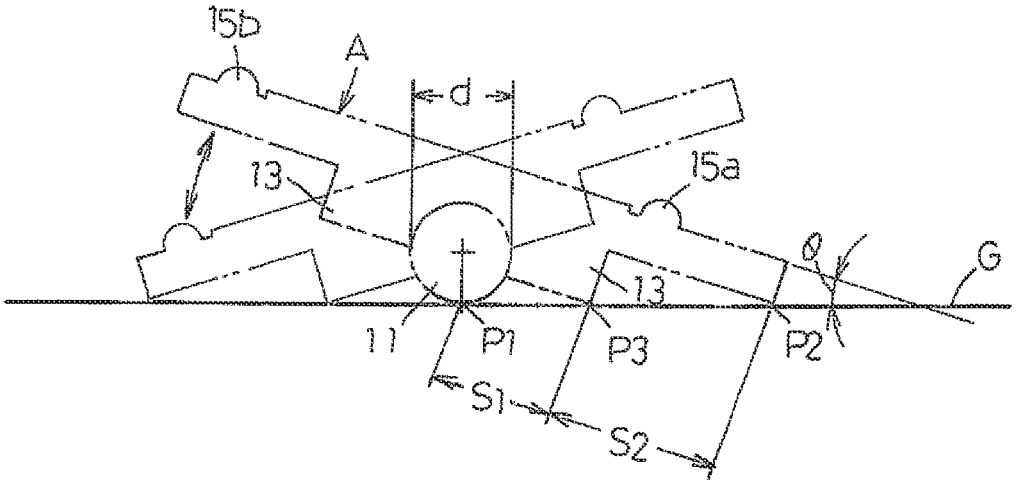
FIG. 7 is a side view showing a seesaw motion of a base plate.

In any case, the base plate 10 supported by the round bar 11 extending (crossing) in the left-right direction along the longitudinal center line O-O of the base plate 10 and the pair of front and rear square bars 13 holding the round bar 11 therebetween is at a constant installation height H (for example, 58 mm to 75 mm both inclusive, preferably 60 mm) from the grounding surface G, and performs a seesaw motion in the front-rear direction as shown in FIG. 7 such that the front end portion and the rear end portion of the long sides y are alternately and equally raised and lowered with the round bar 11 as a rotation (arcing motion) fulcrum.

It is considered that with an inclination angle θ of the base plate 10 intersecting the grounding surface G during the seesaw motion set to, for example, 10 degrees to 25 degrees both inclusive, preferably 15 degrees, and with the installation height H of the base plate 10, especially when the user stands on the base plate 10 with both feet side by side, the user is prevented from feeling uneasy, slipping down the base plate 10 and falling over.

When the installation height H of the base plate 10 is higher than 75 mm and the inclination angle θ of the base plate 10 is steeper than 25 degrees, an elderly user may slip down the base plate 10 and fall over especially when the user stands on the base plate 10 on both feet, and on the other hand, when the installation height H of the base plate 10 is lower than 58 mm and the inclination angle θ of the base plate 10 is less than 10 degrees, there is not any risk of the above, but on the contrary, the action force (load) applied to the user's body for stretching or training, etc. by the seesaw motion of the base plate 10 may become weak or insufficient, so that a strong and sufficient effect cannot be obtained.

When the base plate 10 is inclined at the constant angle θ, as shown in FIG. 7, a total of three parts including an arc surface portion P1 of the round bar 11, a corner portion (corner ridgeline) P2 of each of the long sides y of the base plate 10, and a corner portion (corner ridgeline) P3 of each of the two square bars 13, which are arranged side by side respectively at predetermined intervals S1 and S2 and at predetermined steps, are set to be grounded at approximately the same time.

Further, since the three parts P1, P2 and P3 extend in parallel with the round bar 11 by the same constant length as the long sides y of the base plate 10 and come into so-called line contact with the grounding surface G, when the user pushes down (steps on) any part of the base plate 10 from any direction and with force of any magnitude, the three parts can exert effective sticking resistance against swinging which is like sliding on the grounding surface G of the base plate 10, and not only it is possible to keep the base plate 10 in a stable and firm installation state without any risk of swinging in all directions (360 degrees), but it is possible for the base plate 10 to exert a high load-bearing capacity for loads applied from above with the superimposed grounding at the three parts P1, P2, and P3.

On the other hand, a pair of front and rear finger/toe hooking ridges 15*a* and 15*b* are arranged in parallel with the round bar 11 near the long sides y (near the front and rear end portions) on the upper surface of the base plate 10, and a protective mat 16 for preventing the user's hands or feet from slipping is laid between the front and rear finger/toe hooking ridges 15*a* and 15*b* on the same upper surface.

The two finger/toe hooking ridges 15*a* and 15*b* are each made of a solid rubber body, each have a semicircular cross section or a chevron cross section having a constant width w (for example, 15 mm to 30 mm both inclusive) and a constant height h (for example, 15 mm to 20 mm both inclusive), and each extend in the left-right direction of the base plate 10 in the same manner as the round bar 11, and the user may use the two finger/toe hooking ridges 15*a* and 15*b* in the form of hooking (entangling) the fingers of the hand or the toes of the foot on either one or both of the pair of front and rear parallel ridges which maintain a constant separation distance D (for example, 190 mm to 250 mm both inclusive) to exercise the gripping force of the fingers or toes, or in the form of placing the palm of the hand or the sole of the foot on the ridges to stimulate the pressure points (so-called shiatsu massage).

In the case of the illustrated embodiment, the solid rubber body is attached fixedly to the upper surface of the base plate 10 using an adhesive, but a hollow body may be employed instead of the solid body to exhibit high elasticity, and a synthetic resin, a wooden material, or the like which is harder than the rubber may be formed into a quadrangular or other polygonal cross section in addition to the above-described semicircular cross section or a chevron cross section.

In the illustrated embodiment, a pair of front and rear parallel finger/toe hooking ridges 15*a* and 15*b* having the same sectional shape, material, and size including the width w and the height h are arranged near the asymmetrical front and rear end portions (near the long sides) of the base plate 10 which have a lengthwise (near and far) difference in the separation distance from the longitudinal center line O-O (the front finger/toe hooking ridge 15*a* is nearer/closer to the longitudinal center line O-O than the rear finger/toe hooking ridge 15*b*), but they may also be arranged at symmetrical positions with respect to the longitudinal center line O-O, and although not illustrated, the sectional shape, the material, and/or the size of the pair of front and rear finger/toe hooking ridges 15*a* and 15*b* may be changed to be different from each other.

Figure 8:
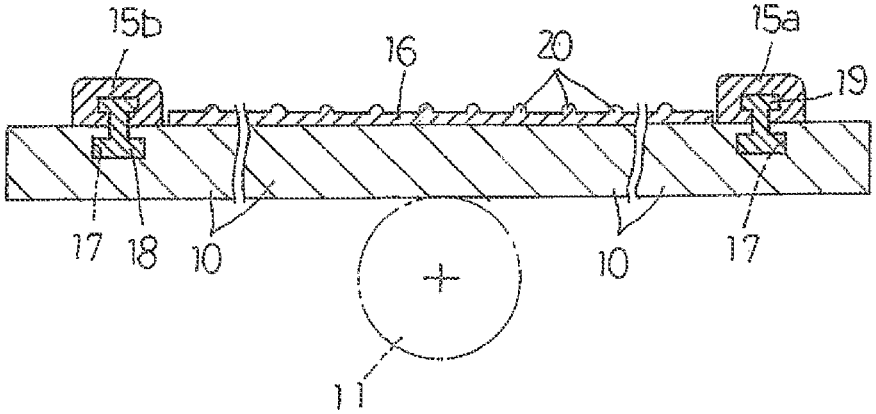
FIG. 8 is a side sectional view showing an embodiment of a partially modified configuration in which a finger/toe hooking ridge is attached to the base plate.

Further, as is clear from the partially modified embodiment shown in FIG. 8 which exemplifies another mounting means for each of the finger/toe hooking ridges 15*a* and 15*b*, grooves (slide guide grooves) 17 such as channel grooves or dovetail grooves opened upward are notched in the base plate 10, and on the other hand, leg rails 18, to which various finger/toe hooking ridges 15*a* and 15*b* having different sectional shapes, materials and/or sizes, etc. are integrally attached as crowns, may be removably inserted in the left-right lateral direction into the corresponding grooves 17, so that the finger/toe hooking ridges 15*a* and 15*b* may be used after being attached to the upper surface of the base plate 10.

In this case, the grooves 17 may not be notched in the base plate 10, and the leg rails 18 may be integrally projected upward from the base plate 10, and various separate finger/toe hooking ridges 15*a* and 15*b* having different sectional shapes, materials and/or sizes, etc. may be inserted and fixed to large-diameter head portions 19 having a slip-off preventing function of the leg rails 18 removably in the left-right lateral direction.

The common leg rails 18 inserted into the grooves 17 and the separate finger/toe hooking ridges 15*a* and 15*b* inserted to the locking head portions 19 of the leg rails 18 which are integrally projected upward from the base plate 10 may be made of a synthetic resin, rubber extruded material, a machined wooden material, or the like.

Figure 9:
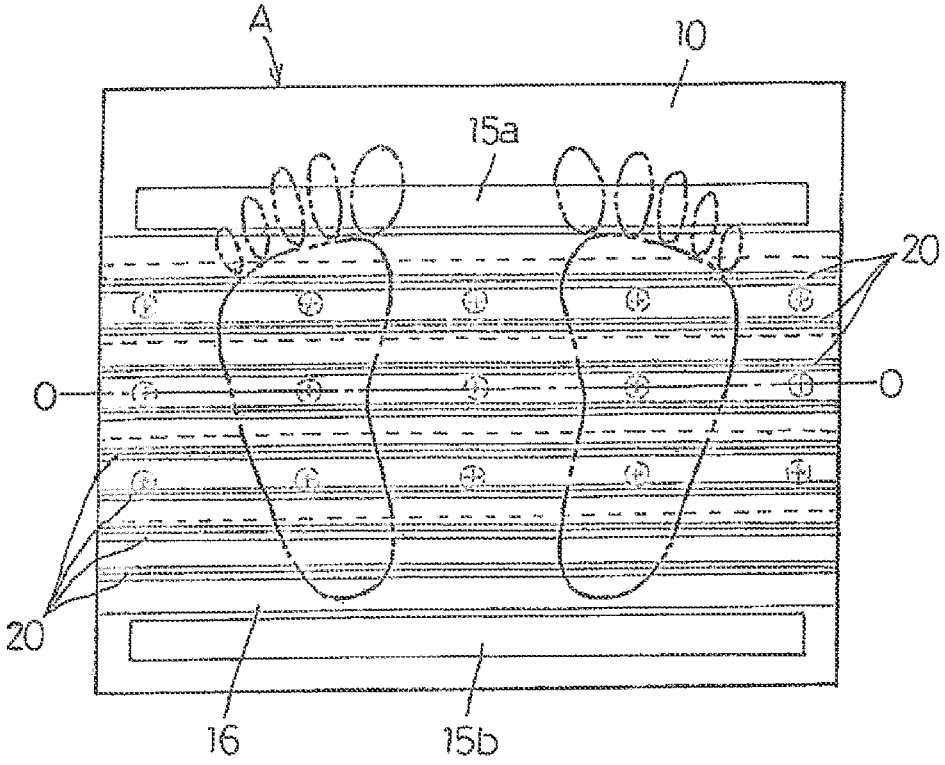
FIG. 9 is a plan view showing a positional relation between feet placed on the base plate.

In any case, when the user places his or her feet on the base plate 10, as shown in FIG. 9, the middle parts in length of the feet are positioned on the longitudinal center line O-O of the base plate 10 and a plurality of desired toes including his or her big toes are hooked (entangled) on the finger/toe hooking ridge 15*a* near one of the front and rear end portions (preferably the front) of the base plate 10 (near the long side), and meanwhile, the heels of the feet may or may not be placed on the other remaining finger/toe hooking ridge 15*b*.

Since the length of the user's feet may be shorter than the separation distance D between the parallel finger/toe hooking ridges 15*a* and 15*b* arranged on the upper surface of the base plate 10, the other finger/toe hooking ridge 15*b* serves as a stopper for preventing the user's feet from slipping down the upper surface of the base plate 10 when the heels of the feet are not placed.

Further, the protective mat 16 is made of a rubber, soft synthetic resin, thermoplastic elastomer or other soft materials having a constant thickness (for example, 1.5 mm to 2.0 mm both inclusive), and is attached and fixed to the upper surface of the base plate 10 using an adhesive in order to safely protect the user's hands, feet, etc.

In addition, the protective mat 16 has a plurality of (eight in the illustration) fine non-slip ridges 20 each having a chevron cross section or a semicircular cross section of a constant height (for example, 1.0 mm to 1.5 mm both inclusive) on the upper surface to prevent slipping of the user's hands or feet, and the non-slip ridges 20 are arranged in parallel with the finger/toe hooking ridges 15*a* and 15*b* in the left-right direction of the base plate 10.

Here, although not illustrated, as long as the user's hands and feet placed on the protective mat 16 of the base plate 10 can be kept in a non-slip state and the pressure points on the palms of the hands and soles of the feet can be stimulated (so-called shiatsu massage), a large number of scattered non-slip protrusions may be integrally projected from the upper surface of the protective mat 16 instead of the non-slip ridges 20, or the upper surface of the protective mat 16 itself may be formed integrally as an uneven (nashiji) rough surface.

Since the protective mat 16 is laid on the upper surface of the base plate 10, the large number of the flat-headed screws 12 and 14 which integrally assemble the base plate 10 with each of the round bar 11 and the pair of front and rear square bars 13 are all completely covered from above. Thus, the exposed head portions of the flat-headed screws 12 and 14 do not injure the hands and feet of the user, and the upper surface of the base plate 10 can be easily cleaned and kept sanitary.

The seesaw exercise device A according to the illustrated preferred embodiment has the above-described configuration, and thus can be conveniently used by anyone on a daily basis for the purposes of not only stretching a desired part of the body as shown in FIGS. 11 to 17, but also training, rehabilitation, and other health promotion.

Figure 11:
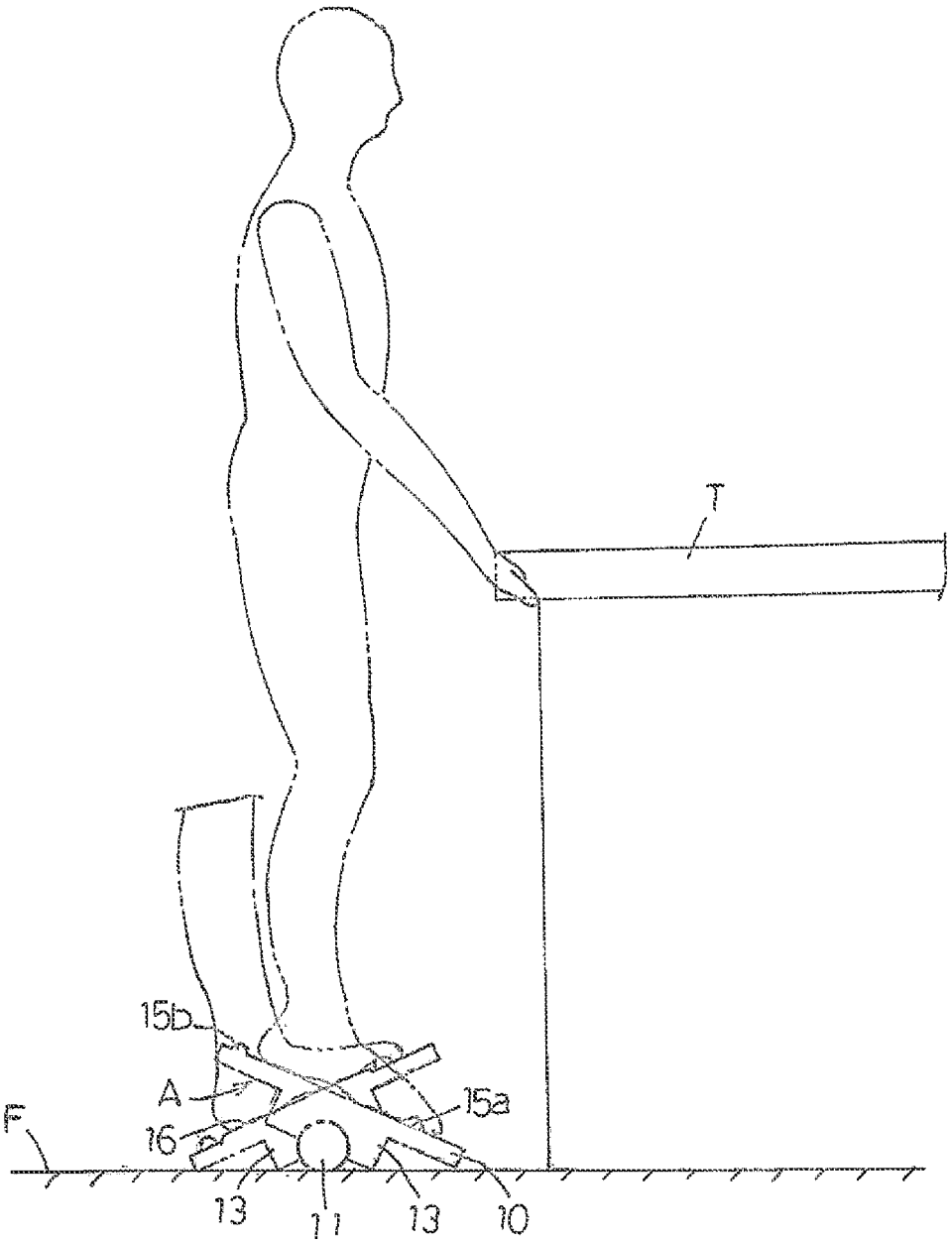
FIG. 11 is a side view showing a first example of use of the seesaw exercise device.
Figure 12:
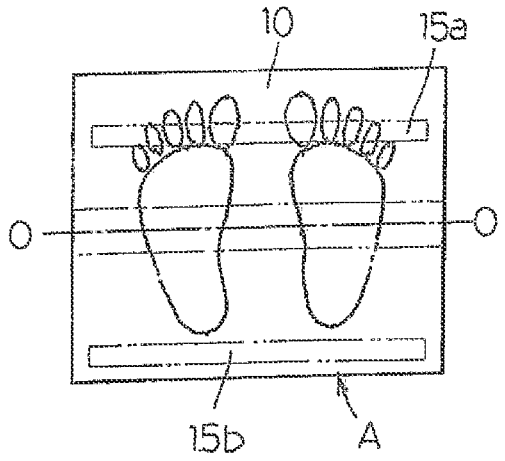
FIG. 12 is a plan view showing the positional relation between the feet shown in FIG. 11.

That is, in the first example of use shown in FIGS. 11 and 12, among FIGS. 11 to 17, which show various examples of use, the user places both feet side by side on the base plate 10 while standing safely and holding an unillustrated pole, a desk top T, etc. erected on the floor F with both hands, or sitting on a chair, and repeats a motion of stepping on the base plate 10 with the heels of both feet in the backward-sloping state and a motion of stepping on the base plate 10 with the tips of toes of both feet in the forward-sloping state, thereby the user's Achilles tendon, triceps surae muscles (soleus and gastrocnemius muscles), etc. can be stretched. Especially, when the user performs the above-described motions in a standing posture, the motions are useful for training the sense of balance, and when the user performs the above-described motions in a sitting posture, the motions are useful for training the pelvis and strengthening the pelvic floor muscles, etc.

Although not illustrated, the device can stretch the triceps surae muscles, stimulate and strengthen the tibialis anterior and tibialis posterior muscles, and flex the ankles, etc. in the same manner as in FIGS. 11 and 12 by placing his or her both feet on the base plate 10 with his or her feet spread in the front-rear direction and repeating a motion of stepping on the base plate 10 with the heel of the left foot in the backward-sloping state and a motion of stepping on the base plate 10 with the tips of toes of the right foot in the forward-sloping state together with back-and-forth movements of the body weight.

Figure 13:
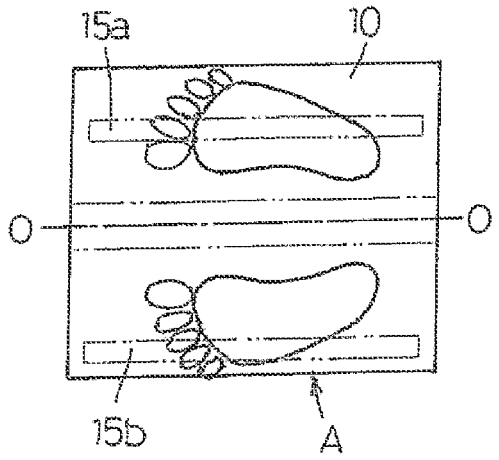
FIG. 13 is a side view showing a second example of use of the seesaw exercise device in terms of a positional relation between the feet placed on the base plate.

In the second example of use shown in FIG. 13, the user places both feet on the front and rear end portions of the base plate 10 while standing safely with one hand holding an unillustrated pole or a handrail (handle), etc. erected on the floor F or both hands placed on a wall, or sitting on a chair, and alternately repeats the motion of pushing down (stepping on) the front end portion of the base plate 10 with the right foot and the motion of pushing down (stepping on) the rear end portion of the base plate 10 with the left foot, thereby making it possible to perform rehabilitation of walking practice. Further, shifting the body weight in the left-right direction during this process can achieve correction of the pelvis, hip joints, and posture, and stimulation of the vastus *medialis* muscle and vastus lateralis muscle, etc., and also provides a training for the sense of balance, especially when the user performs the motions described above in a standing posture.

Figure 10:
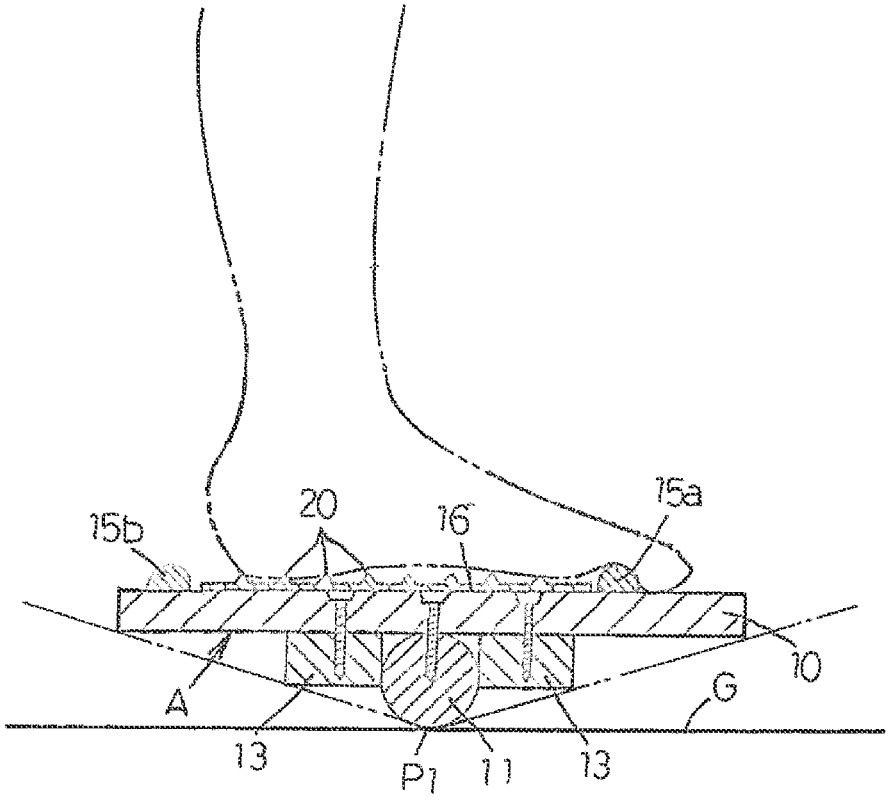
FIG. 10 is a side sectional view of FIG. 9.

In the first example of use shown in FIGS. 11 and 12, desired toes, particularly big toes, of both feet placed on the base plate 10 performing the seesaw motion are hooked (entangled) on either the front or rear (preferably front) finger/toe hooking ridge 15*a* as is apparent from the enlarged views of FIGS. 9 and 10, and in the second example of use shown in FIG. 13, a plurality of toes, particularly including big toes, of both feet are clamped to (entangled on) the pair of front and rear finger/toe hooking ridges 15*a* and 15*b* respectively as shown in FIG. 13. In either example, the gripping force (toe strength) of the toes and the plantar muscles, etc. can be strengthened and trained in both of the examples.

In addition, the protective mat 16 provided with a plurality of non-slip ridges 20 or a large number of scattered non-slip protrusions is laid on the upper surface of the base plate 10 performing the seesaw motion, and the sole (bottom surface) of the user's one or both feet placed on the base plate 10 is always locked with the non-slip ridges 20 or the non-slip protrusions. Accordingly, pressure points can be stimulated (shiatsu massage) and blood circulation in the lower limbs can be promoted.

Figure 14:
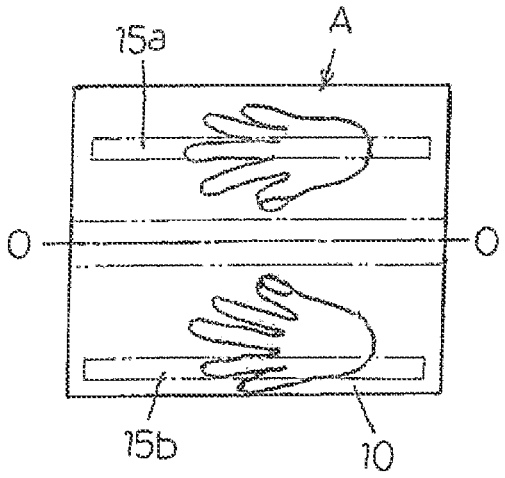
FIG. 14 is a plan view showing a third example of use of the seesaw exercise device in terms of a positional relation between hands placed on the base plate.

In the third example of use shown in FIG. 14, the user places both hands on the front and rear end portions of the base plate 10 with the seesaw exercise device A placed on an unillustrated sofa, bed, etc., and alternately repeats the motion of pushing down and inclining the front end portion of the base plate 10 with the right hand and the motion of pushing down and inclining the rear end portion of the base plate 10 with the left hand. This makes the motions useful for training to improve the flexibility of the wrist joint.

At this time, by hanging (entangling) the fingers of both hands on the pair of front and rear finger/toe hooking ridges 15*a* and 15*b* arranged on the base plate 10 or pressing the palm of the hand against the non-slip ridges 20 or the non-slip protrusions of the protective mat 16, the pressure points of the hand can be stimulated (shiatsu massage), and the blood circulation promoting effect can be obtained.

Figure 15:
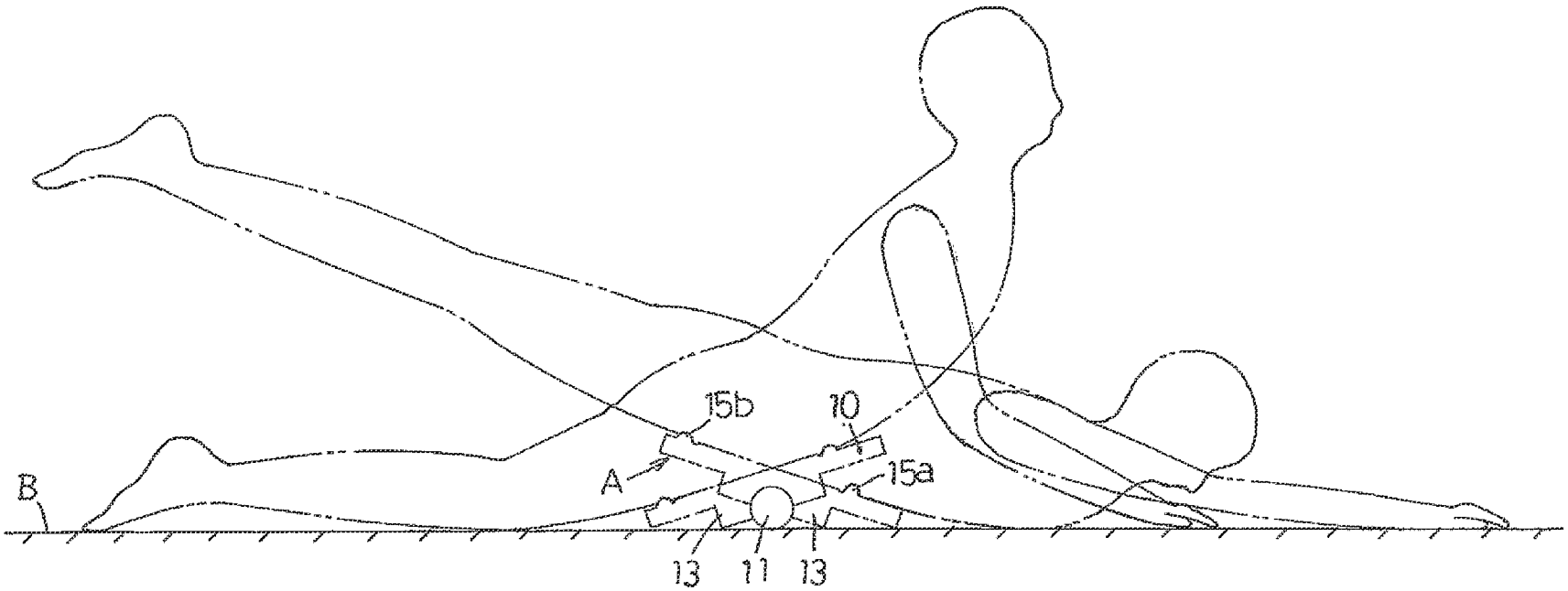
FIG. 15 is a side view showing a fourth example of use of the seesaw exercise device.
Figure 16:
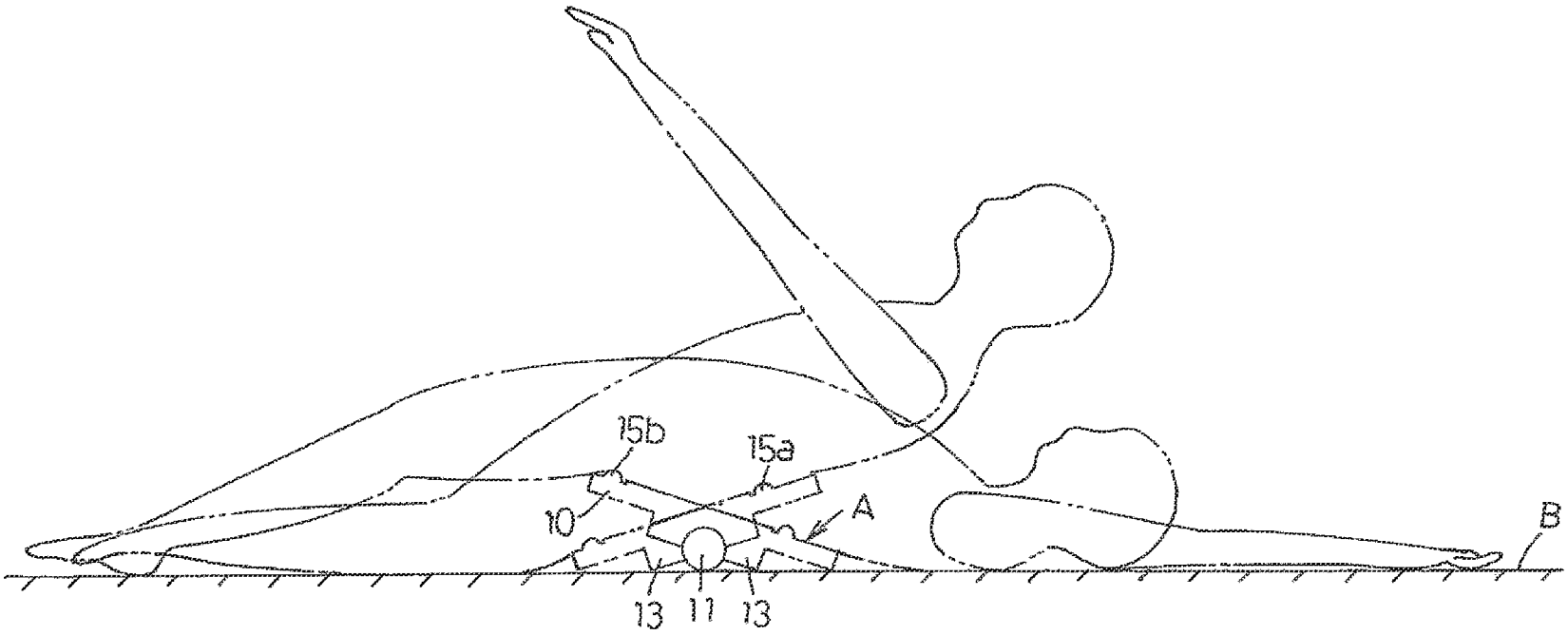
FIG. 16 is a side view showing a fifth example of use of the seesaw exercise device.
Figure 17:
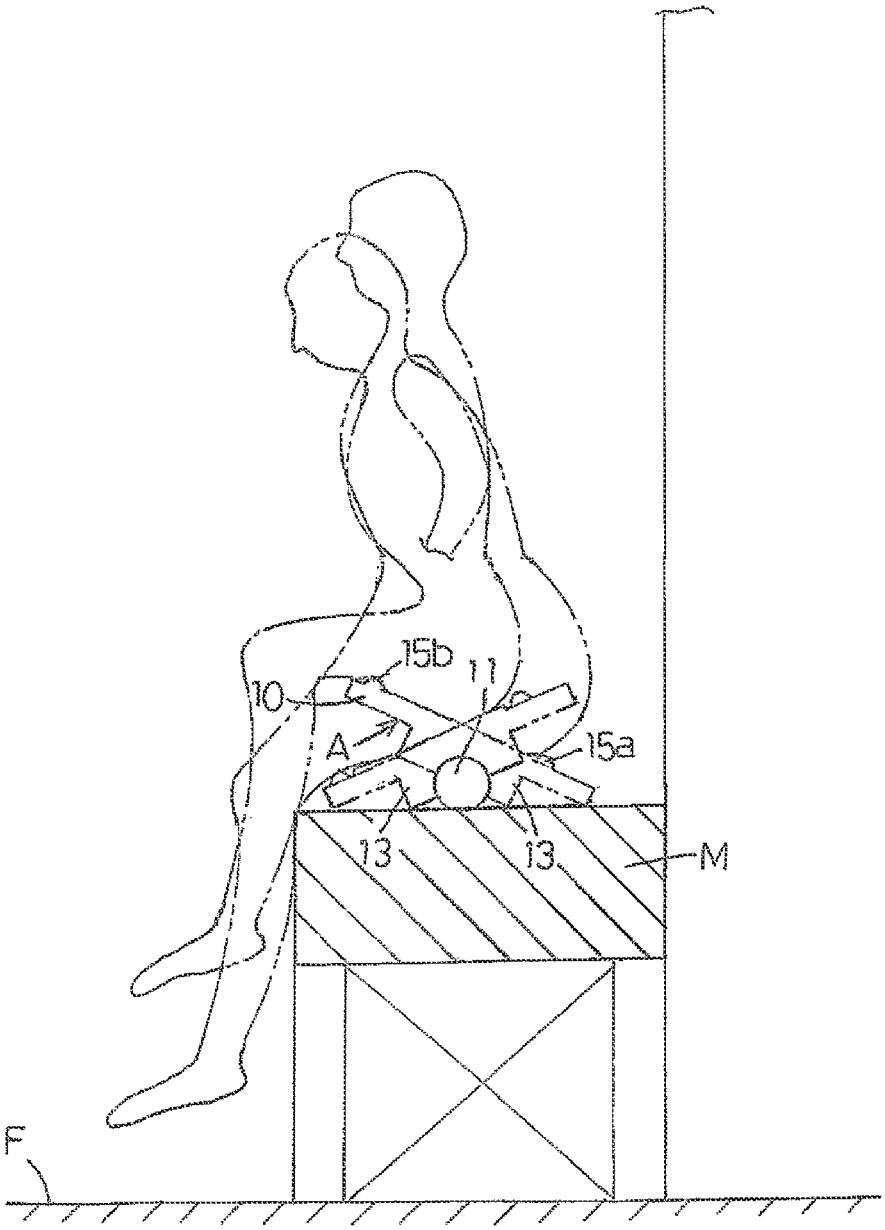
FIG. 17 is a side view showing a sixth example of use of the seesaw exercise device.

Further, as shown in the fourth to sixth examples of use shown FIGS. 15 to 17, the seesaw exercise device A can be provided for the user to perform stretching, training, rehabilitation or the like of the upper body (arms, shoulders, back) on a daily basis by placing not only the lower body (mainly legs and loins) but also the periphery of the waist of the body on the base plate 10.

In other words, in the fourth example of use shown in FIG. 15, the user places his or her belly in a posture of lying on the stomach on the base plate 10 with the seesaw exercise device A placed on a bed B or sofa, and alternately pushes down and inclines the front and rear end portions of the base plate 10 by the belly while repeating push-ups (bending of the arms), thereby making it possible to strengthen the muscles of both arms and improve the flexibility or the like of the periphery of the scapulae. At that time, when the user adds the motion of bending the back and the motion of raising both legs from the sofa or the bed B, it is also possible to strengthen back muscles and make correction or the like of the posture can also be corrected.

On the other hand, in the fifth example of use shown in FIG. 16, the user places his or her back in a lying down posture on the base plate 10 with the seesaw exercise device A placed on the bed B or sofa, and alternately pushes down and inclines the front and rear end portions of the base plate 10 with his or her back while repeatedly bending his or her arms and the upper half of his or her body together. This allows the device to improve flexibility of the shoulder joint and make correction or the like of the spine.

In this case, it is also possible to correct the pelvis and strengthen the pelvic floor muscles and gluteus maximus muscles, etc. by placing the user's hip (buttocks) on the base plate 10 instead of the user's back and repeating the same seesaw motion, or to promote blood flow in the lower limbs by placing the user's calves on the base plate 10 and repeating the seesaw motion of the base plate 10 to stimulate (massage) the calves.

In the sixth example of use shown in FIG. 17, with the seesaw exercise device A placed on a sofa M, chair, or bed, the user sits on the base plate 10 of the seesaw exercise device A with his or her both feet off the floor F, and swings his or her upper body in the front-rear direction and moves his or her hip (buttocks) up and down to perform the seesaw motion of the base plate 10 in the front-rear direction. Accordingly, the device can correct the pelvis and hip joints, strengthen the pelvic floor muscles and gluteus maximus muscles, and extend the sacrospinatus muscle, etc.

As described above, the seesaw exercise device A of the illustrated embodiment is a generally flat product having the constant installation height H which is, for example, 58 mm to 75 mm both inclusive, preferably 60 mm, from the grounding surface G of the base plate 10. Therefore, although not illustrated, the seesaw exercise device A may be, for example, interposed between the back of the user seated on a chair and the backrest of the chair so as to be repeatedly pushed by the back of the user, thereby making it possible to correct the posture or provide stimulation (shiatsu massage) by the finger/toe hooking ridges 15*a* and 15*b* of the base plate 10.

In short, in the seesaw exercise device A according to the illustrated preferred embodiment, when the base plate 10 which performs the seesaw motion in the front-rear direction with the round bar 11 as the rotation fulcrum is pushed down (stepped on) by the user so as to be inclined to intersect with the grounding surface G, the total of three parts including the arc surface portion P1 of the round bar 11, the corner portion (corner ridgeline) P3 of each of the two square bars 13, and the corner portion (corner ridgeline) P2 of each of the long sides y of the base plate 10, which are arranged side by side respectively at the predetermined intervals S1 and S2 and at the predetermined steps, are grounded so that they are in, so to speak, line contact with the grounding surface G. Thus, there is not any risk that the base plate 10 may accidentally swing around in all directions during use, and is kept in a stable and firm installation state. As a result, elderly people, sickly people, and physically handicapped people may also use the device safely without danger.

Further, the base plate 10 is supported in a state that the central portion is the heaviest portion by the round bar 11 having a diameter d larger than the plate thickness t of the base plate 10 and the pair of front and rear reinforcing square bars 13 holding the round bar 11 therebetween, and the installation height H from the grounding surface G is preferably 60 mm, which is relatively low, and the inclination angle θ of the base plate 10 intersecting the grounding surface G is also set to a gentle angle, preferably 15 degrees. Therefore, even elderly people and sickly people can safely and conveniently perform the seesaw exercise while standing on the base plate 10 without feeling uneasy.

The illustrated embodiment and the partially modified embodiments thereof, each of which is a product as the seesaw exercise device A made of the wooden material, are relatively light in weight, fit well in both Japanese and Western interiors, and do not damage the floor F or a carpet thereof, etc. Therefore, an elderly user can also handle each product in the same manner as furniture and carry it, and set it, to a desired place. Here, all of the base plate 10, the round bar 11 and the two square bars 13 may be made of a fiber-reinforced resin (FRP) or other high-strength hard synthetic resins instead of a wooden material. In this case, a tinting color may be applied.

What is claimed is:

1. A seesaw exercise device comprising: a base plate that is rectangular in a plan view; a round bar that is attached fixedly to a lower surface of the base plate along a longitudinal center line of the base plate in a manner of extending in a left-right direction by a constant length which is as long as a long side of the base plate, and a pair of parallel square bars that are attached fixedly to the lower surface of the base plate in a state of sandwiching the round bar in a front-rear direction, wherein when the base plate is pushed down by a user, the base plate performs a seesaw motion in the front-rear direction with the round bar as a rotation fulcrum, and three parts including an arc surface portion of the round bar, a corner portion of each of the two square bars, and a corner portion of each of the long sides of the base plate, which are separated from one another, are grounded.

2. The seesaw exercise device according to claim 1, wherein a pair of front and rear finger/toe hooking ridges which are identical to or different from each other are arranged in parallel with the round bar near the long sides serving as front and rear end portions on an upper surface of the base plate.

3. The seesaw exercise device according to claim 2, wherein a protective mat for preventing hands or feet of the user from slipping is laid between the front and rear finger/toe hooking ridges arranged on the upper surface of the base plate.

4. The seesaw exercise device according to claim 1, wherein the round bar serving as the rotation fulcrum of the base plate which performs the seesaw motion and the two square bars serving as reinforcing members of the round bar are each attached fixedly to the lower surface of the base plate by an adhesive and/or a plurality of flat-headed screws screwed from above the base plate.

5. The seesaw exercise device according to claim 1, wherein the base plate, the round bar, and the two square bars are all made of a wooden material, a size of the base plate is set to 300 mm×360 mm both inclusive, a thickness of the base plate is set to 15 mm to 25 mm both inclusive, a diameter of the round bar is set to 40 mm to 50 mm both inclusive, a size of each of the two square bars is set to 25 mm×45 mm inclusive, and an inclination angle of the base plate, at which the base plate intersects a grounding surface during the seesaw motion, is set to 10 degrees to 25 degrees both inclusive.

* * * * *